US007134259B2

(12) United States Patent
Huang

(10) Patent No.: US 7,134,259 B2
(45) Date of Patent: Nov. 14, 2006

(54) VACUUM SEALER

(76) Inventor: Mao-Sen Huang, No. 242-2, Dong-Lan St., Dongshih Town, Taichung-Hsien (TW)

( * ) Notice: Subject to any disclaimer, the term of this patent is extended or adjusted under 35 U.S.C. 154(b) by 21 days.

(21) Appl. No.: 11/081,229

(22) Filed: Mar. 16, 2005

(65) Prior Publication Data

US 2006/0207227 A1 Sep. 21, 2006

(51) Int. Cl.
*B65B 31/04* (2006.01)

(52) U.S. Cl. ..... 53/512; 53/374.9

(58) Field of Classification Search ..... 53/512, 53/374.9, 375.6

See application file for complete search history.

(56) References Cited

U.S. PATENT DOCUMENTS

| | | | | |
|---|---|---|---|---|
| 3,965,946 | A * | 6/1976 | D'Alo | 141/51 |
| 4,756,140 | A * | 7/1988 | Gannon | 53/434 |
| 5,239,808 | A * | 8/1993 | Wells et al. | 53/512 |
| 5,481,852 | A * | 1/1996 | Mitchell | 53/432 |
| 6,185,913 | B1 * | 2/2001 | Cappi et al. | 53/511 |
| 6,256,968 | B1 * | 7/2001 | Kristen | 53/512 |
| 2003/0110741 | A1 * | 6/2003 | Wang | 53/512 |
| 2005/0050856 | A1 * | 3/2005 | Baptista | 53/434 |
| 2005/0050860 | A1 * | 3/2005 | Sung | 53/512 |
| 2006/0053748 | A1 * | 3/2006 | Ahn et al. | 53/434 |

FOREIGN PATENT DOCUMENTS

| | | | |
|---|---|---|---|
| JP | 10-273111 | * | 10/1998 |
| JP | 2002-308215 | * | 10/2002 |
| SU | 793785 B | * | 1/1981 |

* cited by examiner

*Primary Examiner*—Stephen F. Gerrity

(57) ABSTRACT

A vacuum sealer includes a base member formed with a hollow platform having a first sealing ring secured on the platform and a support. A drawing hole is defined in the top of the platform within the first sealing ring. A heating plate is laterally secured on a front edge of the platform. A pumping device is mounted on the support for drawing out the air in a plastic bag that is purposed to be sealed. A transparent presser has a rear side pivotally mounted on the platform and selectively pressed on the top of the platform. A second sealing ring is secured on a bottom of the presser and fully airtightly abuts the first sealing ring when the presser is pressed on the platform.

4 Claims, 6 Drawing Sheets

VACUUM SEALER

BACKGROUND OF THE INVENTION

1. Field of the Invention

The present invention relates to a sealer, and more particularly to a vacuum sealer used for a plastic bag.

2. Description of Related Art

A conventional vacuum sealer usually uses a flexible tube inserted into the plastic bag to draw out air from the plastic bag before sealing. However, the flexible tube is inconveniently operated and the conventional vacuum sealer has two steps for sealing the plastic bag. One is the drawing process and the other is the hot-melt sealing process. As a result, an improved conventional vacuum sealer is marketed to solve the above problem. The improved conventional vacuum sealer has two hoods pivotally mounted to each other to clamp the plastic bag for drawing out the air in the plastic bag and sealing the plastic bag by hot-melt. However, the operator can not see the situation of the plastic bag after being clamped by the two hoods and confirm the drawing step is truly operated. As a result, the operator needs to check the sealed plastic bag to ensure well sealing the plastic such that the work effect is reduced.

The present invention has arisen to mitigate and/or obviate the disadvantages of the conventional vacuum sealers.

SUMMARY OF THE INVENTION

The main objective of the present invention is to provide an improved vacuum sealer. The operator can clearly check the operating process via a transparent presser of the present invention.

To achieve the objective, the vacuum sealer in accordance with the present invention comprises a base member including a front portion and a rear portion, the front portion is formed with a platform having a first sealing ring secured on the platform. The platform is hollow and a drawing hole is defined in the top of the platform within the first sealing ring. A heating plate is laterally secured on a front edge of the platform and the rear portion of the base member is formed with a support. A pumping device is mounted on the support. The pumping device includes a pump mounted on the support and a tube. The tube has a first end extending into the hollow platform and communicating with the drawing hole, and a second end connected to the pump. A pressure sensor is mounted on the support and connected to the tube. An electromagnetic valve is mounted on the support and electrically connected to the pressure sensor. The electromagnetic valve guides the air into the tube to relieve the vacuum condition in the tube when finishing sealing the plastic bag. A transparent pressure has a rear side pivotally mounted on the platform and selective pressed on the top of the platform. A second sealing ring is secured on a bottom of the presser and fully airtightly abuts the first sealing ring and the pressure sensor is provided to sense the pressure between the first sealing ring and the second sealing when the pressure is pressed on the platform. A thermal insulator wicker is laterally attached to the bottom of the presser and corresponds to the heating plate to prevent the heat from being transferred from the heating plate to the transparent presser.

Further benefits and advantages of the present invention will become apparent after a careful reading of the detailed description with appropriate reference to the accompanying drawings.

DETAILED DESCRIPTION OF THE INVENTION

Figure 1:
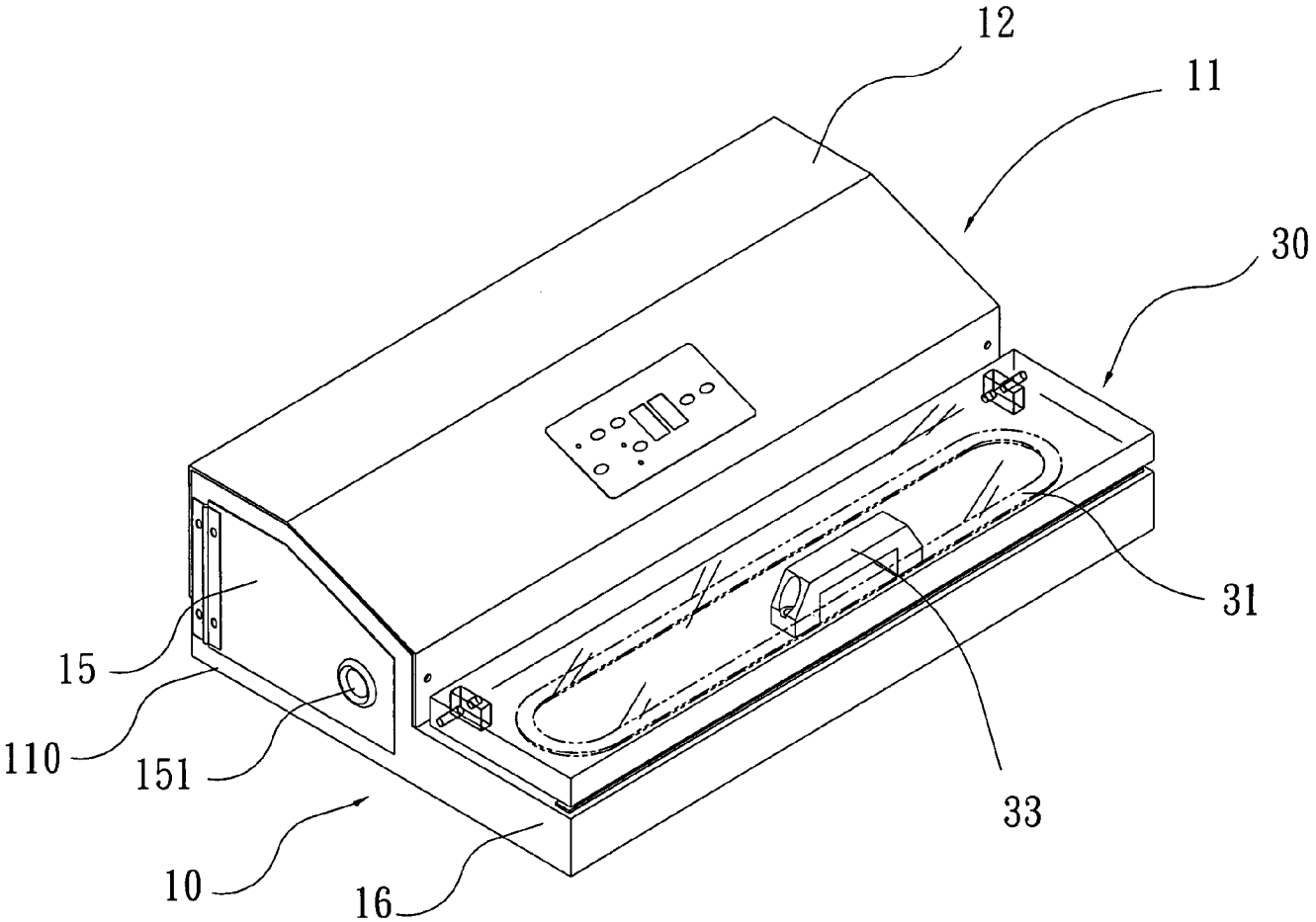
FIG. 1 is a perspective view of a vacuum sealer in accordance with the present invention.
Figure 2:
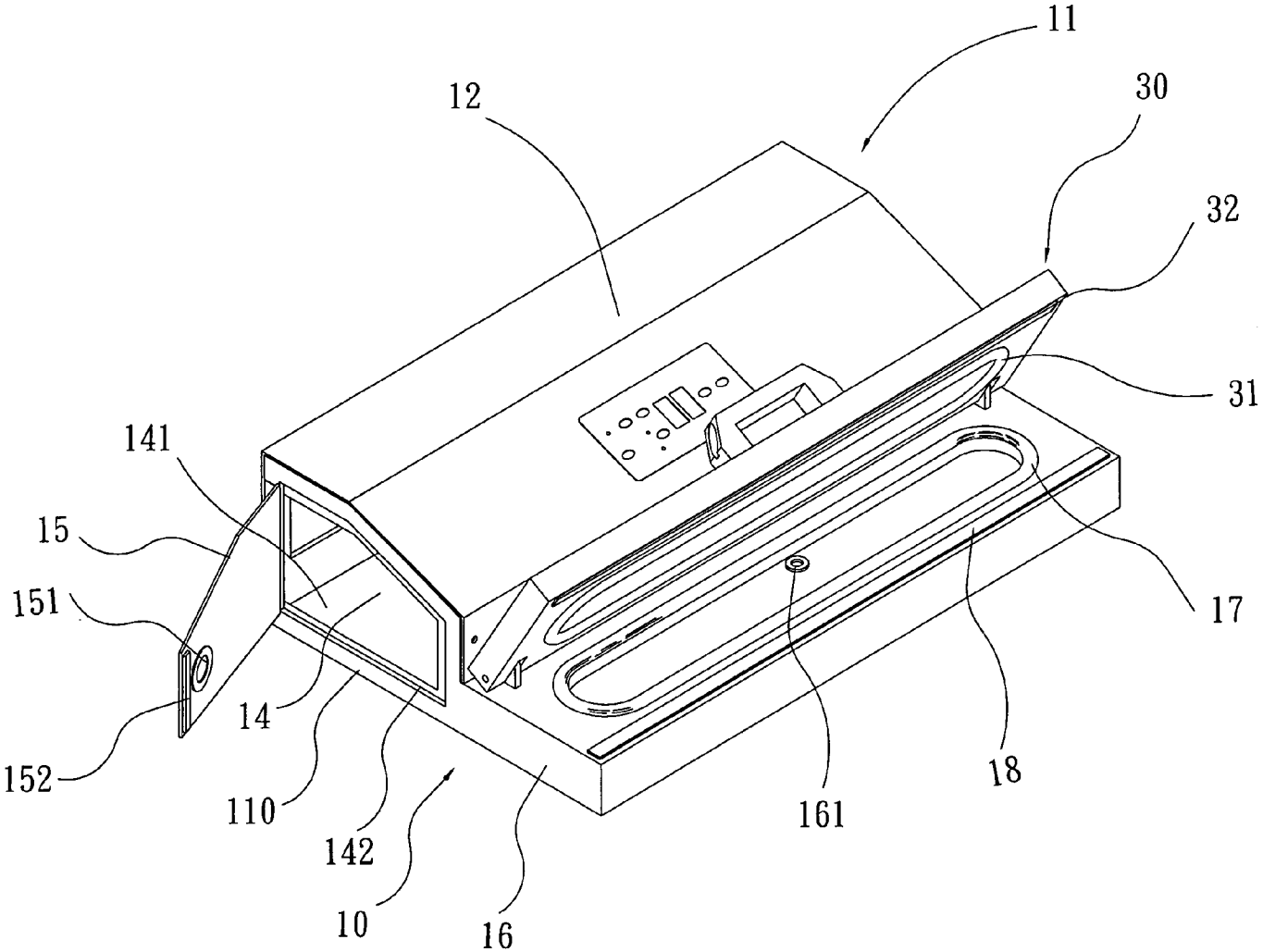
FIG. 2 is a perspective view of the vacuum sealer in FIG. 1 when the presser is lifted and the door is opened.
Figure 3:
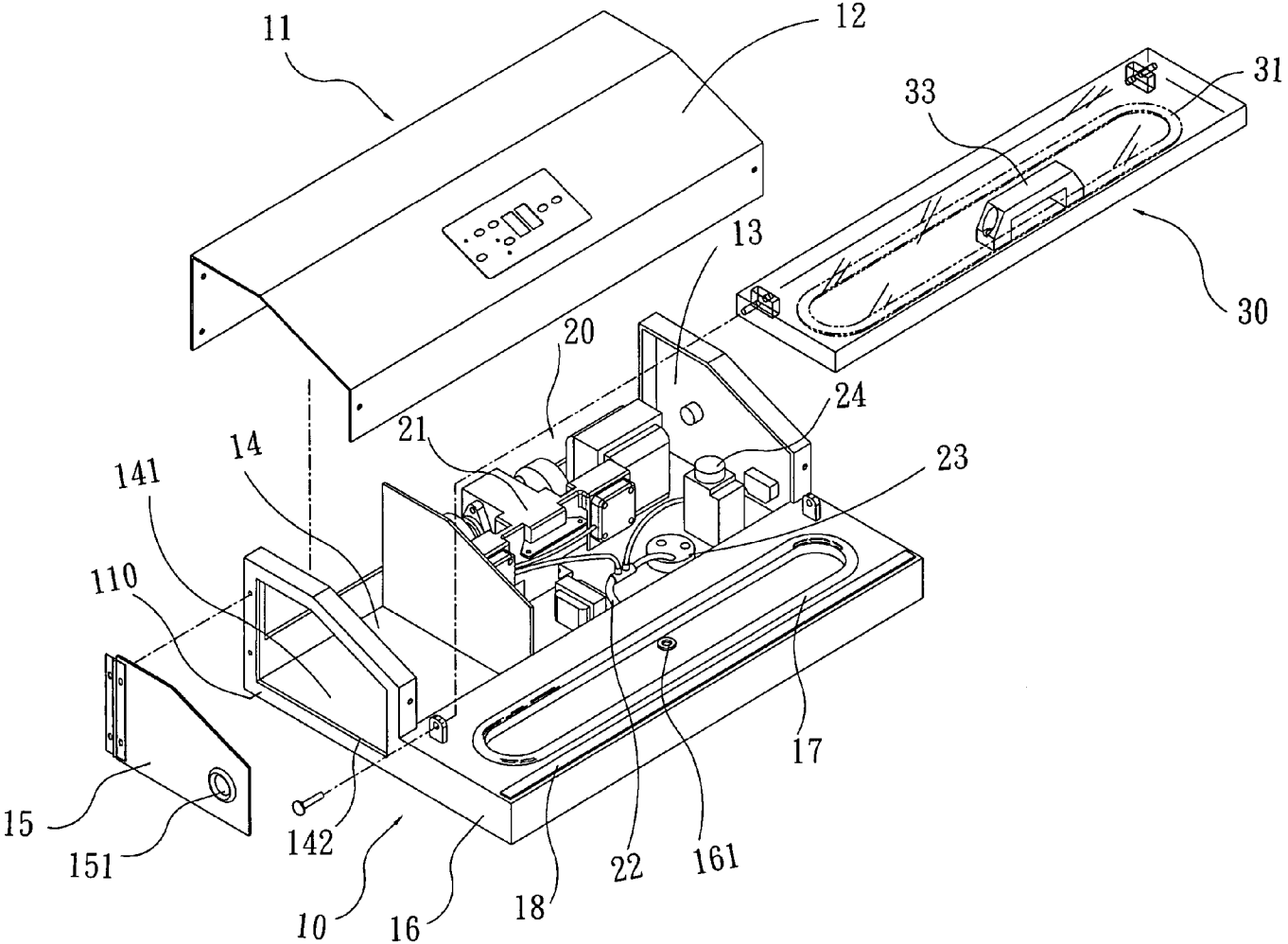
FIG. 3 is an exploded perspective view of the vacuum sealer in FIG. 1.
Figure 4:
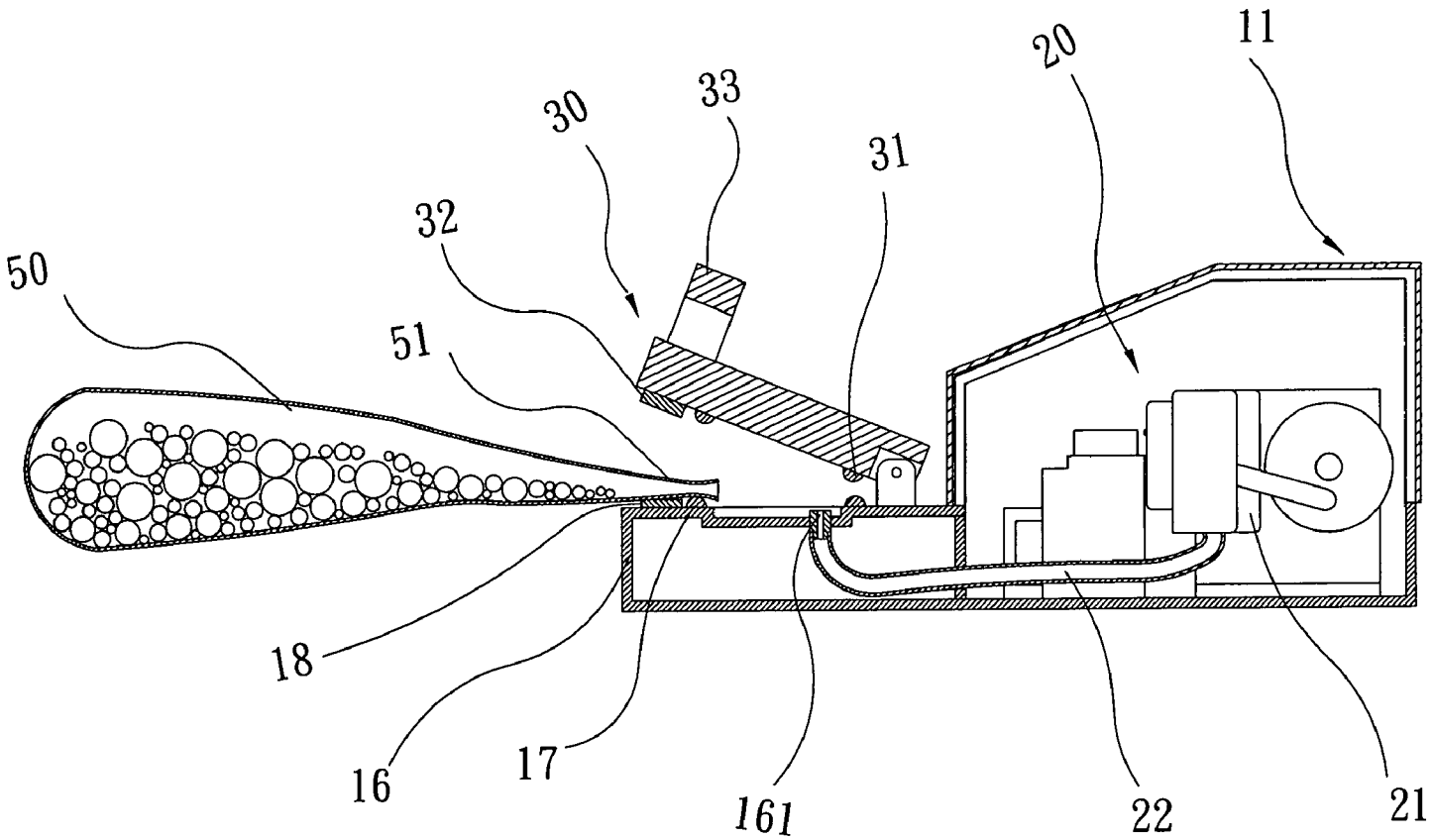
FIG. 4 is a side cross-sectional view of the vacuum sealer in FIG. 1 before being operating.

Referring to the drawings and initially to FIGS. 1–4, a vacuum sealer in accordance with the present invention is provided to seal a plastic bag (50) comprises a base member (10), a pumping device (20) is disposed on a rear portion (11) of the base member (10) and a presser (30) pivotally mounted on a front portion of the base member (10).

Figure 5:
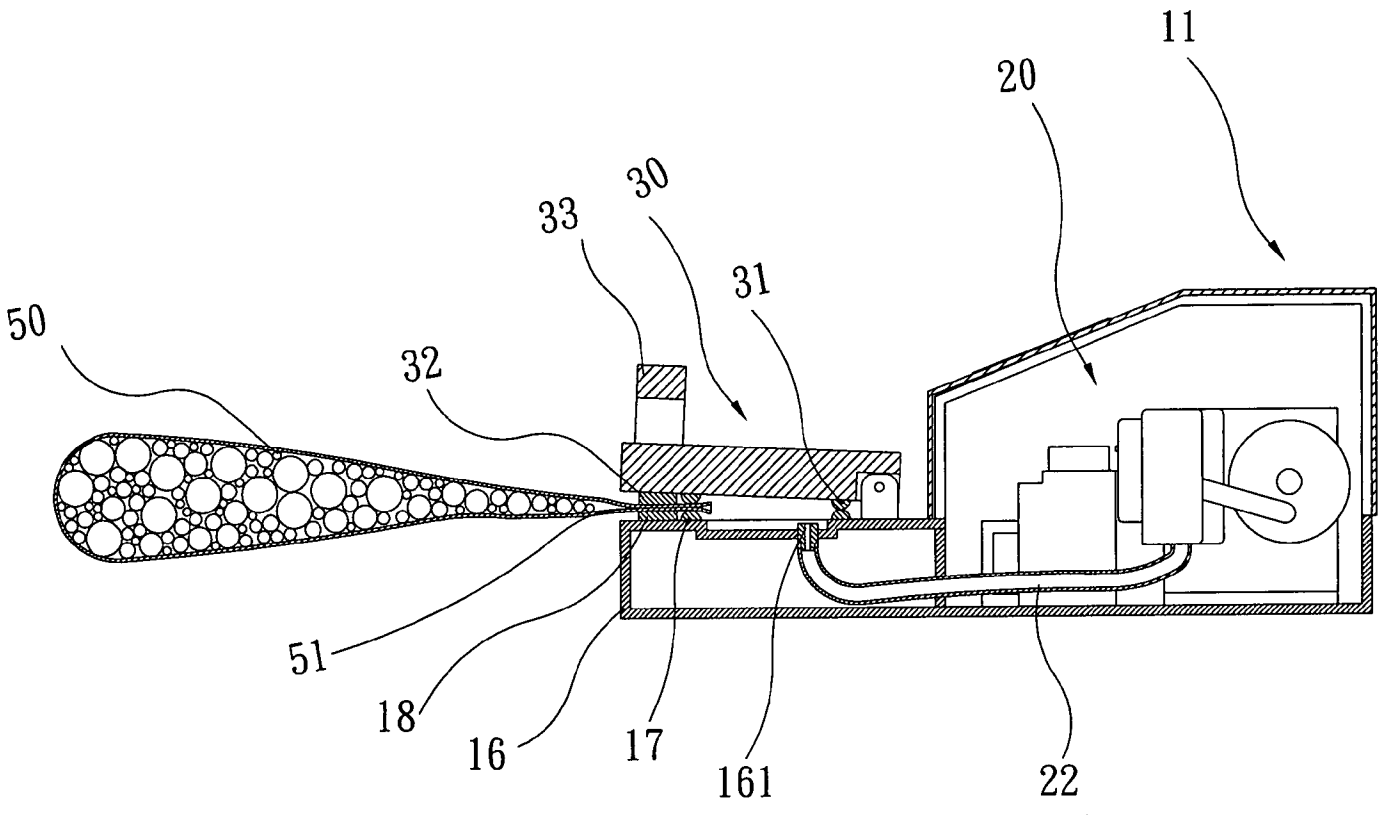
FIG. 5 is a side cross-sectional view of the vacuum sealer in FIG. 1 during operating.
Figure 6:
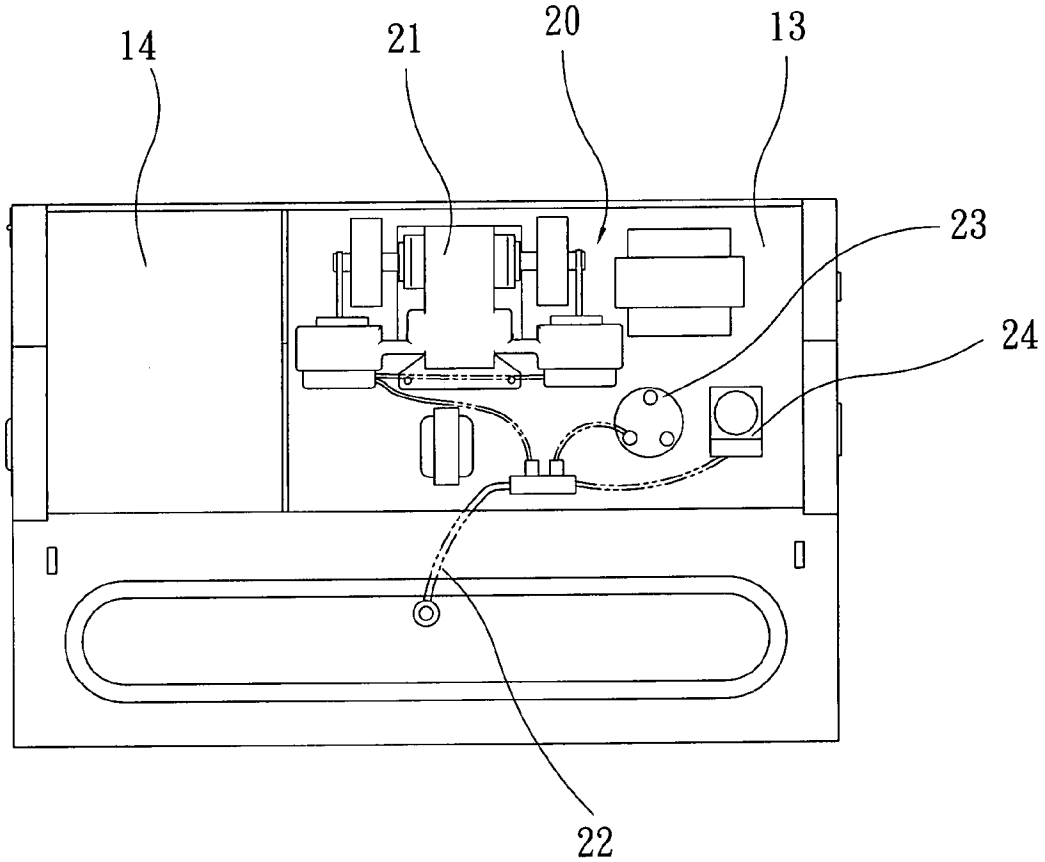
FIG. 6 is a top plan view of the vacuum sealer in FIG. 1 when the cover is detached.

The front portion of the base member (10) formed with a platform (16) having a first sealing ring (17) secured on the platform (16). The platform (16) is hollow, as shown in FIG. 5, and a drawing hole (161) is defined in the top of the platform (16) within the first sealing ring (17). A heating plate (18) is laterally secured on a front edge of the platform (16).

The rear portion (11) of the base member (10) includes a support (110) and is divided into a receiving space (13) and a container (14), wherein the receiving space (13) is provided to receive the pumping device (20) and the container (14) is provided to receive tool or power cord. An opening (141) is defined in one side of the rear portion (11) of the base member (10) and communicates with the container (14). A door (15) is pivotally mounted adjacent to the opening (141) for closing the opening (141) and has a shape corresponding to that of the opening (141). A bore (151) is defined in and extends through the door (15) for user to easily operating the door (15). A magnet (152) is secured on a free end of the door (15) for selectively holding the door (15) in place. An annular groove (142) is defined to surround and communicate with the opening (141). The annular groove (142) has a depth equaling to a thickness of the door (15) for receiving the periphery of the door (15).

The pumping device (20) includes a pump (21) mounted on the support (110) and a tube (22). The tube (22) has a first end extending into the hollow platform (16) and communicating with the drawing hole (161), and a second end connected to the pump (21). A pressure sensor (23) is mounted on the support (110) and connected to the tube (22). An electromagnetic valve (24) is mounted on the support (110) and electrically connected to the pressure sensor (23). The electromagnetic valve (24) will guide the air into the tube (22) to relieve the vacuum condition in the tube (22) when finishing sealing the plastic bag (50). A cover (11) is attached to a top of the base member (10) for closing the receiving space (13) and the container (14).

The presser (30) of the present invention is transparent and has a size corresponding to that of the platform (16). The presser (30) has a rear side pivotally mounted on the platform (16) and selectively pressed on the top of the platform (16). A second sealing ring (31) is secured on a bottom of the presser (30) and fully airtightly abuts the first sealing ring (17) and the pressure sensor (23) is provided to sense the pressure between the first sealing ring (17) and the second sealing ring (31) when the presser (30) is pressed on the platform (16). A handle (33) is mounted on a top of the presser (30) for user to easily operate the presser (30). A thermal insulator wicker (32) is laterally attached to the bottom of the presser (30) and corresponds to the heating plate (18) to prevent the heat from being transferred from the heating plate (18) to the presser (30).

With reference to FIGS. 2 and 4–6, when operating the vacuum sealer of the present invention, the presser (30) is lifted and the opened end of the plastic bag (50) is located within the first sealing ring (17). The presser (30) is moved to abut the platform (16) and the opened end of the plastic bag (50) is located in an airtight chamber formed by the first sealing ring (17) and the second sealing ring (31). The operator can clearly check whether the opened end of the plastic bag (50) is in a right position or not via the transparent presser (30).

The air in the plastic bag (50) is drawn out via the opened end thereof through the drawing hole (161) and the tube (22) when the pump (21) is operated. The heating plate (18) is heated to seal the opened end of the plastic bag (50) when the pressure sensor (23) sensing a vacuum condition being formed in the tube (22).

The electromagnetic valve (24) guides air into the chamber between the first sealing ring (17) and the second sealing ring (31) to release the vacuum condition after the opened end of the plastic bag (50) being well sealed. As a result, the operator can easily lift the presser (30) and removed the sealed plastic bag (50) for next operation.

Although the invention has been explained in relation to its preferred embodiment, it is to be understood that many other possible modifications and variations can be made without departing from the spirit and scope of the invention as hereinafter claimed.

What is claimed is:

1. A vacuum sealer comprises:

a base member including a front portion and a rear portion, the front portion formed with a platform having a first sealing ring secured on the platform, the platform being hollow and a drawing hole defined in the top of the platform within the first sealing ring, a heating plate laterally secured on a front edge of the platform, the rear portion of the base member formed with a support, the rear portion of the base member divided into a receiving space and a container, wherein the receiving space is provided to receive a pumping device and the container is adapted to receive a tool and a power cord, an opening defined in one side of the rear portion of the base member and communicating with the container, a door pivotally mounted adjacent to the opening for closing the opening, a bore defined in and extending through the door for a user to easily operate the door and a magnet secured on a free end of the door for selectively holding the door in place;

the pumping device mounted on the support, the pumping device includes a pump mounted on the support and a tube, the tube having a first end extending into the hollow platform and communicating with the drawing hole, and a second end connected to the pump, a pressure sensor mounted on the support and connected to the tube, an electromagnetic valve mounted on the support and electrically connected to the pressure sensor, electromagnetic valve guiding the air into the tube to relieve the vacuum condition in the tube when sealing of the plastic bag is finished; and a transparent presser having a rear side pivotally mounted on the platform and selectively pressed on the top of the platform, a second sealing ring secures on a bottom of the presser and fully airtightly abuts the first sealing ring, and the pressure sensor provided to sense the pressure between the first sealing ring and the second sealing ring when the presser is pressed on the platform, a thermal insulator wicker laterally attached to the bottom of the transparent presser and relative to the heating plate to prevent the heat from being transferred from the heating plate to the presser.

2. The vacuum sealer as claimed in claim 1 further comprising a cover mounted on a top of the base member for closing the receiving space and the container.

3. The vacuum sealer as claimed in claim 2, wherein the base member comprises an annular groove defined to surround and communicate with the opening, the annular groove having a depth equaling to a thickness of the door for receiving the periphery of the door.

4. The vacuum sealer as claimed in claim 1, wherein the base member comprises an annular groove defined to surround and communicate with the opening, the annular groove having a depth equaling to a thickness of the door for receiving the periphery of the door.

* * * * *